US007285031B2

(12) United States Patent
Mair et al.

(10) Patent No.: US 7,285,031 B2
(45) Date of Patent: Oct. 23, 2007

(54) FIN SYSTEMS

(75) Inventors: Robin Mair, Hanalei, HI (US); Mitch Haynie, Hanalei, HI (US)

(73) Assignees: Larry William Allison, Lakewood, CA (US); Mike G. Stavros, San Pedro, CA (US)

( * ) Notice: Subject to any disclaimer, the term of this patent is extended or adjusted under 35 U.S.C. 154(b) by 409 days.

(21) Appl. No.: 10/907,879

(22) Filed: Apr. 19, 2005

(65) Prior Publication Data

US 2006/0019559 A1 Jan. 26, 2006

Related U.S. Application Data

(60) Provisional application No. 60/589,487, filed on Jul. 20, 2004.

(51) Int. Cl.
*B63B 35/79* (2006.01)
*B63B 3/38* (2006.01)

(52) U.S. Cl. ..... 441/79; 114/39.15; 114/140

(58) Field of Classification Search ..... 441/74, 441/79; 114/39.15, 127, 132–137, 140, 143; D12/309; D21/769
See application file for complete search history.

(56) References Cited

U.S. PATENT DOCUMENTS

| | | | |
|---|---|---|---|
| 3,422,471 | A | 1/1969 | Morey et al. |
| 3,516,099 | A | 6/1970 | Morey et al. |
| 3,585,663 | A | 6/1971 | Johnson |
| 3,659,300 | A | 5/1972 | Johnson |
| 3,965,514 | A | 6/1976 | Shafer et al. |
| 4,379,703 | A | 4/1983 | Mizell |
| 4,421,492 | A | 12/1983 | Leva |
| 4,798,549 | A | 1/1989 | Hirsch |
| 4,804,347 | A | 2/1989 | Ross |
| 4,846,745 | A | 7/1989 | Lobe |
| 4,904,215 | A | 2/1990 | Sherwood |
| D331,089 | S | 11/1992 | Monical, III |
| 5,176,096 | A | 1/1993 | Molnar et al. |
| 5,176,553 | A | 1/1993 | Tuttle |
| 5,672,081 | A | 9/1997 | Whitty |
| 6,139,383 | A | 10/2000 | Jolly et al. |
| 6,386,933 | B1 | 5/2002 | Rewald et al. |
| 6,752,674 | B2 | 6/2004 | Jolly |
| 6,793,548 | B2 | 9/2004 | Jolly et al. |
| 7,198,532 | B2 * | 4/2007 | Field ..... 441/79 |
| 2002/0039866 | A1 | 4/2002 | Jolly et al. |

(Continued)

FOREIGN PATENT DOCUMENTS

JP 2003306195 A * 10/2003

(Continued)

*Primary Examiner*—Ajay Vasudeva
(74) *Attorney, Agent, or Firm*—Jay L. Politzer

(57) ABSTRACT

FIG. 1 is an exploded view of the invention that consists of a reusable installation guide or router template, (13), which also doubles as a resin dam to secure receptacle, (9), into substrate (19)-(20). Insert (3) resides in receptacle, (9), and accommodates fin, (1), in angled slot (4). The insert, (3), and fin (1), are secured via grub screws, (10), tightened by Allen key (11). This design will accommodate a wide variety of proprietary fins available from numerous manufacturers who bundle their fin mounting systems to be used only with their fins. The fin can be removed, moved laterally within the slot, and canted by changing the insert. The fin is not part of the instant invention.

10 Claims, 4 Drawing Sheets

U.S. PATENT DOCUMENTS

2002/0155769 A1 10/2002 Herbert et al.
2003/0087564 A1 5/2003 Kelley
2003/0092333 A1 5/2003 McCausland et al.
2003/0092334 A1 5/2003 McCausland et al.
2003/0124924 A1 7/2003 McCausland et al.
2003/0220030 A1 11/2003 Jolly
2003/0236039 A1 12/2003 Banys, Jr.
2004/0035346 A1 2/2004 Graeme et al.
2004/0043681 A1 3/2004 Jolly et al.

FOREIGN PATENT DOCUMENTS

WO WO 2004035377 A1 * 4/2004

* cited by examiner

Figure 3: Installation Guide
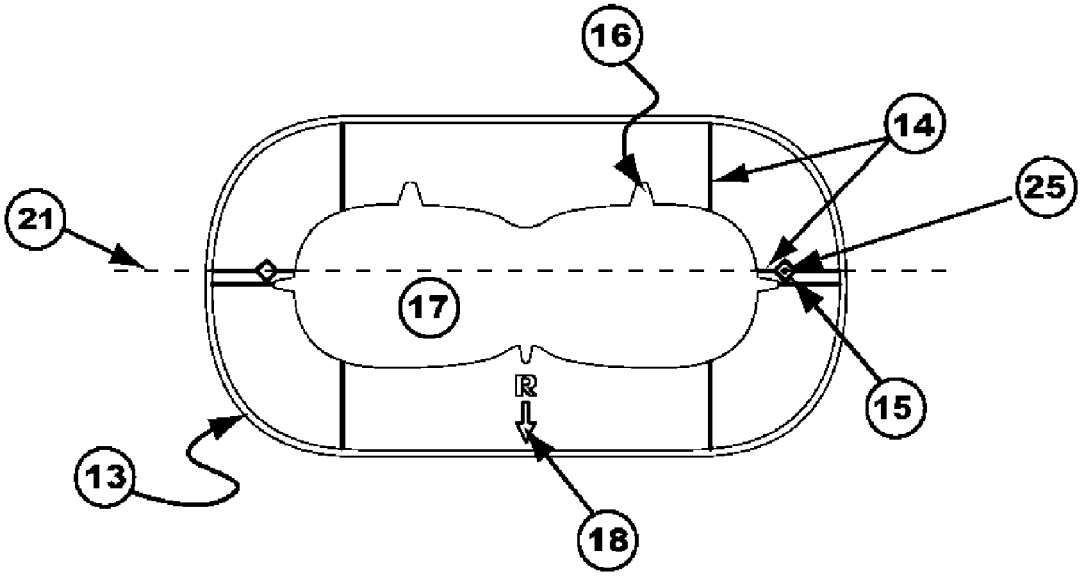
Figure 5: Insert
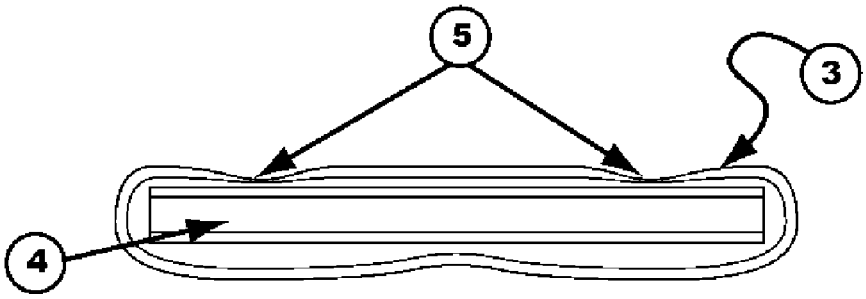
Figure 6: Section Through Insert
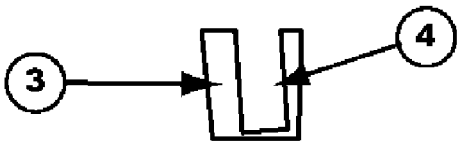

Figure 7: Section Through Receptacle and Insert
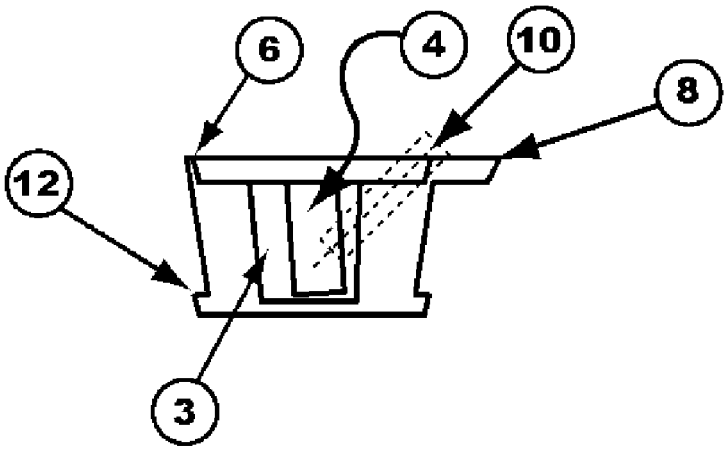
Figure 4: Receptacle
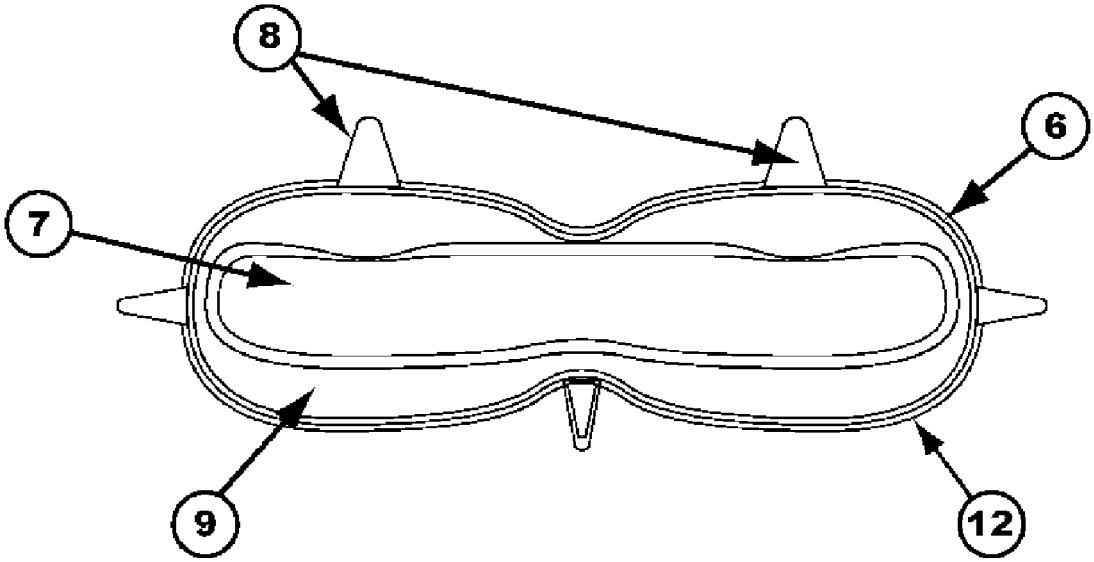

FIN SYSTEMS

BACKGROUND OF THE INVENTION

This is a Non-Provisional of U.S. application No. 60/589,487, filed Jul. 20, 2004.

The instant invention is a fin mounting system for fins primarily on surfboards or other aquatic devices and is classified in Class 441, Subclass 79 which is an indent of Subclass 65. The fin itself is not a part of the invention.

1. Field of the Invention

"Class 441 BUOYS, RAFTS, AND AQUATIC DEVICES: This class includes structure and attachments peculiar to mooring buoys, marker buoys, container buoys and other buoys; structure and attachment peculiar to rafts, and from analogy, to rafting and guiding of floating logs and similar material; water rescue apparatus; and other aquatic devices.

Water rescue apparatus include devices maneuvered on or over the water surface by one person in order to rescue another person, passenger enclosing devices which are not buoys, rafts or boats and garment or other type of buoyant members, commonly known as personal flotation devices which support a user in the water.

Aquatic devices include swimming aids to cause faster or farther propulsion through the water by the user's own swimming strokes, buoyant or non-buoyant devices which support a user and which are caused by external means to roll, skim, glide over or through the water, buoyant underwater viewing devices, and other miscellaneous buoyant support devices.

Subclass 65 WATER SKIMMING OR WALKING DEVICES: This subclass is indented under Class 441. Device constructed so as to permit walking, gliding, or planing on the surface of a body of water while sustaining a user substantially out of contact with the water."

Subclass 79 Having stabilizing surface: This subclass is indented under Subclass 65. Device including a means, such as a keel, fin, etc. which tend to steady the water skimming or walking device."

2. Description of the Related Art

Morey '471—This system provides for a removable center fin. It is not being used today. The instant invention does provide for a fin to be removed but not in this way.

Morey '099—This is another system that provides for a removable center fin. It is not being used today. The instant invention does provide for a fin to be removed but not in this way.

Pope et al '681—This a system that provides for a removable center fin and allows forward and backward adjustment of the fin. The instant invention provides for both removability and forward and back adjustment but not in this way.

Johnson '663—This is another system that provides for a removable center fin and allows forward and backward adjustment of the fin. The instant invention provides for both removability and forward and back adjustment of the fin but not in this way.

Mizell '703—This system provides for a box or receptacle and removable fin. It is installed with a two part router guide. It does not allow for forward and back adjustment. It does not allow for change in fin angle other than with an angled fin, and is complicated to install.

Shafer et al '514—This is a system that provides for a removable center fin. It is not being used today. The instant invention does provide for a fin to be removed but not in this way.

Leva '492—This is a system that provides for a removable center fin. It is not being used today. The instant invention does provide for a fin to be removed but not in this way.

Ross '347—These systems provide for a box or receptacle and removable fin. It is installed with a two part router guide. It does not allow for forward and back adjustment. It does not allow for change in fin angle other than with an angled fin, and is complicated to install.

Lobe '745—This is the center fin box that is used today. It is made by a number of different manufacturers and other than providing for a fin to be removed, and forward and back adjustment it is not similar to the instant invention.

Molnar et al '096—This is a sailboard system that uses opposing conical shapes to secure the fin. It is a removable fin system and does allow for forward and back adjustment.

Tuttle '553—This is a sailboard system that uses opposing conical shapes to secure the fin. It is a removable system and does allow for forward and back adjustment.

Whitty '081—This is the most popular system out there today. It allows for removable fins and uses a grub screw in direct contact with the fins for securing the fins.

Instant Invention Improvements on Other Fin Box Systems

Only an inexpensive panel router, router bit, and installation guide is needed compared with conventional, pricey, complicated, proprietary installation kits.

The installation guide provides four functions: alignment mechanism, router template, receptacle holder, and resin dam. This saves time because only one setup is needed for all four functions.

The instant invention goes in the board flush with the deck surface. No clay, measuring, or guessing. The angle of the fin is decided by the insert purchased with the box. The fin angle can be changed by using a different insert.

The installation guide is very inexpensive so shops can have multiple set-ups and easy replacement.

The instant invention is designed to work with a lot of different fins from a variety of manufacturers. It will accommodate the widest variety of fins of any box including custom fiberglass, carbon, foam-filled, or any fin with a solid or tabbed base.

The instant invention is made to accommodate a better fin design: a fin with a solid base instead of tabs. This means that the fin flex will be from the fin design not the tabs, the custom fin manufacturers can produce them more efficiently and at less cost, and the consumer can have a wider selection of fin options. Consumers can still use their old fins or buy new ones.

Surfboard manufacturers will no longer have to buy fins to sell with their boards. They can simply put the instant invention in the board and allow the surf shop retailers to sell fins through the retail shop.

Custom fins to go with new boards will be an easy option. Logo fins with manufacturer's, sponsor's, shop's or any marketing logo will be easy to screen onto fins for use in the instant invention. No longer must the consumer use only the fins of the manufacturer of the box.

BRIEF SUMMARY OF THE INVENTION

The instant invention is a fin box system for holding fin(s) in a surfboard or other floatation device. It is achieved by use of a receptacle that is installed into the surfboard during the manufacturing process. This receptacle has an insert with a slot in it that accommodates a wide variety of fin types from different manufacturers. The insert provides the means for numerous adjustments: forward and backward in the slot, cant or fin tilt angle by changing the insert, and different fin types. The insert & fins are held in place by use of grub (headless) screws which screw through the receptacle at an angle and apply pressure to the insert and fin together. The receptacle is installed using a removable installation guide that provides three functions: router template, receptacle holder, and resin dam. The receptacle installs flush to the surface of the surfboard without the need for angle adjustments like most systems. This feature greatly simplifies the manufacturing process.

LIST OF FIGURES

FIG. 1 is an exploded view of the invention which consists of a reusable installation guide or router template, 13, which also doubles as a resin dam to secure receptacle, 9, into substrate 19-20. Insert 3 resides in receptacle, 9, and accommodates fin, 1, in slot 4. The insert, 3, and fin 1, are secured via grub screws, 10, tightened by Allen key 11. A complete legend is provided below.

FIG. 3 is a plan view of the installation guide with indicia 14, and sighting holes 15 to align the guide to the premarked aquatic device and tab locater slots, 16, to accommodate tabs, 8, of receptacle, 9.

FIGS. 4 and 6 are plan and cross-sectional views of the insert, 3, whose slot, 4, can be angled to cant the mounted fin.

FIGS. 5 and 7 show a plan view of the receptacle and a cross-section of the receptacle with internal insert 3.

LEGEND (1) Fin
(2) Fin Base
(3) Asymmetrical Insert
(4) Fin Base Slot
(5) Screw Holes
(6) Resin Dam
(7) Asymmetrical Insert Cavity
(8) Alignment & Support Tabs
(9) Receptacle
(10) Grub Screw
(11) Allen Key
(12) Receptacle Anchor Lip
(13) Installation Guide
(14) Layout Lines
(15) Shaper's Mark Viewport
(16) Tab Locator Slots
(17) Routed Receptacle Hole
(18) Edge Indicator
(19) Fiberglass Laminate
(20) Foam Substrate
(21) Layout Line on Surfboard
(22) Surfboard Rail
(23) Surfboard Stringer [wood]
(24) Surfboard
(25) Shaper's Marks

Installation

Figure 1:
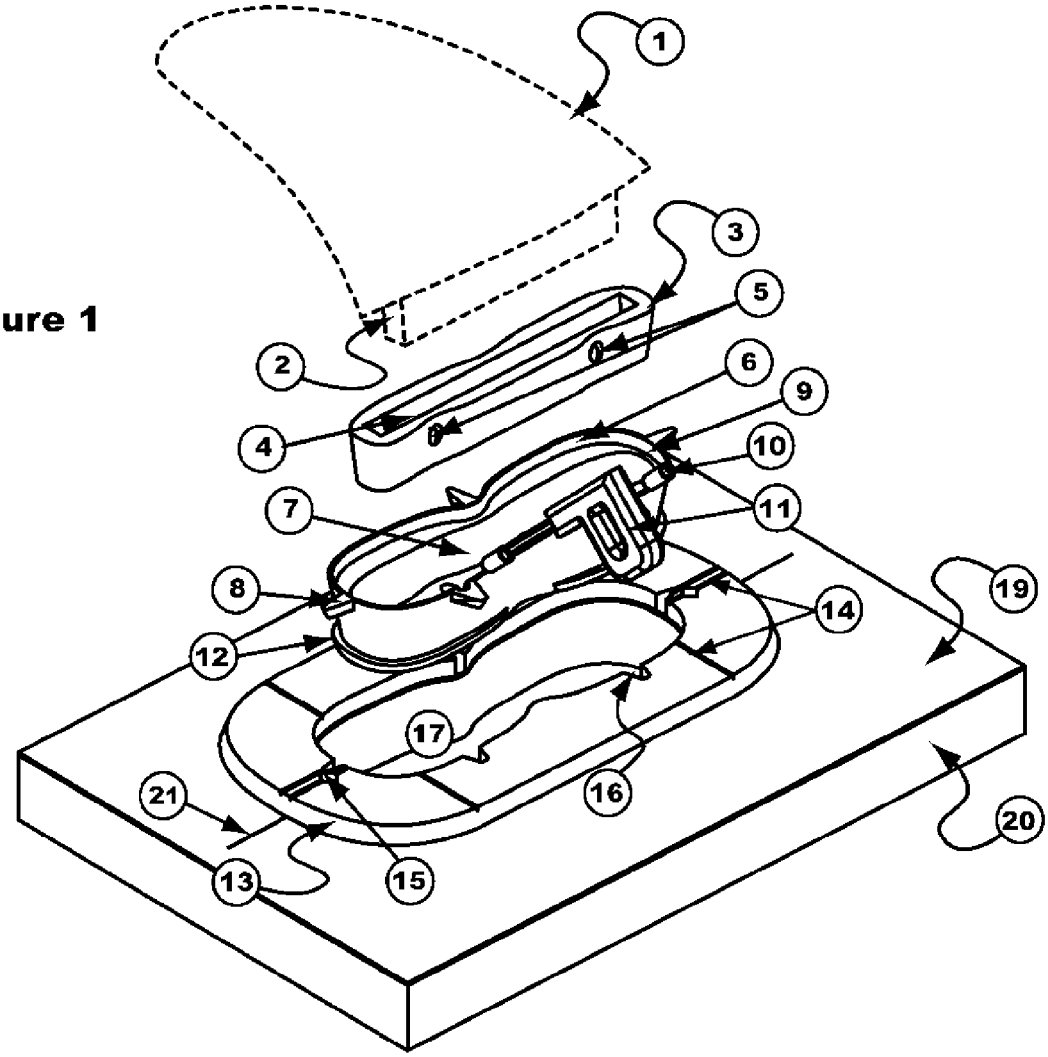
Figure 2:
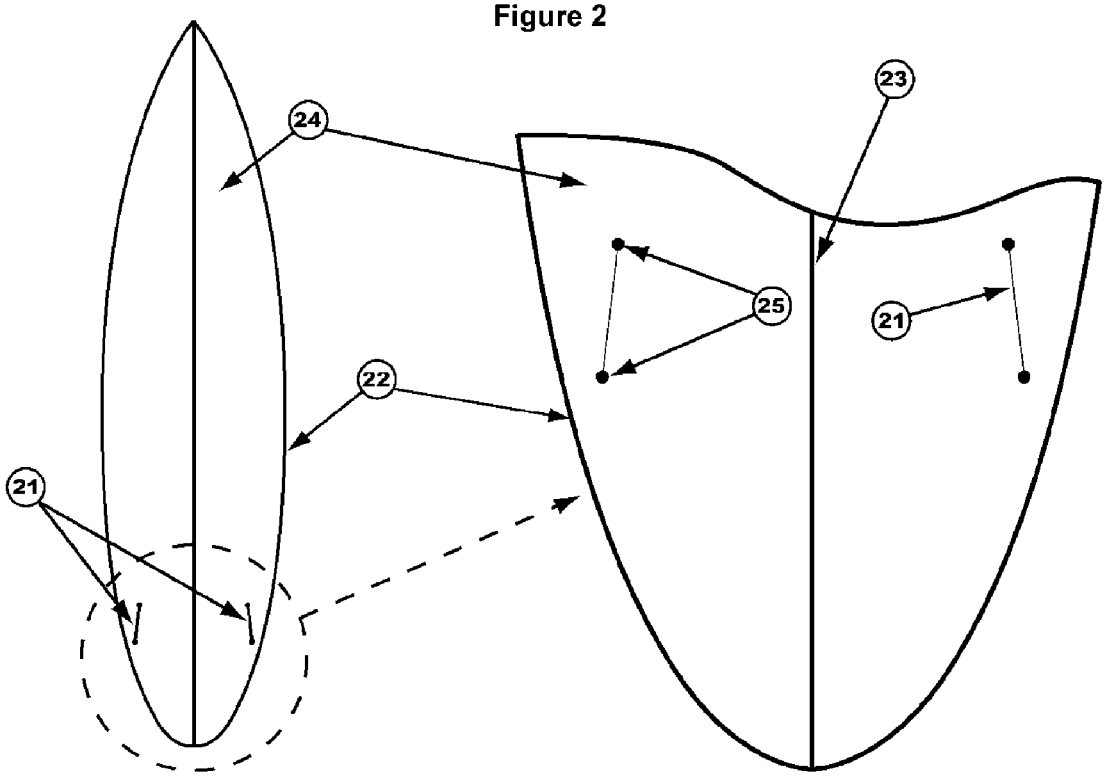
FIG. 2 shows the bottom (water side) of an aquatic device with score marks, 25, or layout lines, 21, indicating center line for fin placement.

As shown in FIG. 1, the aquatic device has a foam core, 20, and fiberglass layers, 19, and a hot coat, not shown. An exemplary device in FIG. 2 may be a surfboard. However, the fin mounting system can be used on a sled, ski, or other device.

During the laminating process extra cloth should be put around the fin areas for added strength. For a surfboard, about 6 oz fiberglass cloth arranged approximately 1½" larger than the receptacle is adequate. The installation guide is a good pattern for cutting the fiberglass. After the board has been hot coated but before sanding, make sure the surface of the fiberglass is smooth and level with no bumps or imperfections in the area of the fins prior to starting the installation.

Steps:

(1) Place the Installation Guide on the board with the "R" on the rail side (outside edge) of the board. For center fins this makes no difference. Align with shaper's marks centering the triangular hole, 15, on the rear shaper's mark. Align the Guide with the front shaper's mark using the lines in the surface of the guide. It may be beneficial to draw a line connecting the marks if the shaper has not already done so. This will make it easy to align the guide. For center receptacles a crossing line is provided to align the shaper's mark at the rear and a center line is provided to align the guide with the center of the stringer, 23, an inset wooden keel.

(2) Secure the Guide in the aligned position using masking tape along three sides making sure the guide stays on the shaper's marks and aligned. The guide should be very secure at this point. It is recommended to use 1½" masking tape so that will be adequate tape on both the board and the guide. Spray adhesive can also be used to secure the installation guide to the surface of the board.

(3) Using a panel router and a ¾" deep router bit with a top bearing roller (a recommended bit is ½" diameter by ¾" deep straight bit with a ½" top roller bearing), route out the inside area of the guide pressing the roller against the inside edge of the guide. If any material is left in the center remove it with the router. When routing the stringer remove small amounts at one time so as to not to shatter or throw pieces of wood around in the removed area.

(4) Using a screw or nail head scratch a groove under the fiberglass around the inside of the cutout area.

(5) Pour a mixture of resin, catalyst, milled fibers, and pigment (optionally) in the bottom of the cutout area to about ⅓ full. Press the Receptacle into the guide making sure that all the tabs are in contact with the surface of the glass. Pour the resin mixture between the guide and the Receptacle until the mixture covers the surface of the fiberglass but not over the edge of the lip on the Receptacle. Be careful not to get resin in the receptacle. The recommended mixture is 1 oz resin with ½ teaspoon milled fiber. It will take about 1 oz of mixture per receptacle.

(6) Once resin has hardened remove the guide by gently peeling it away from the board, screw in the set screws below the top of the receptacle and sand the excess receptacle, tabs, and resin away to leave a smooth finish.

(7) Loosen the set screws and put the fin angle insert into the slot of the side receptacles and loosely tighten the screws to hold the insert in place.

What is claimed is:

1. A fin mounting system of an aquatic device comprising:

a reusable installation guide means to act as a router template for routing a pocket in the underside of an aquatic device and for acting as a resin dam for securing;

a receptacle means adapted to be secured into the routed pocket;

an insert means with a canted slot to receive a fin, the insert means being removably mounted within the receptacle means, the canted slot defined by four substantially vertical sidewalls, each sidewall extending between an opening on a top surface of the insert means and a closed base opposite the opening, wherein the canted slot causes the accommodated fin to be mounted in a laterally canted position with respect to the underside of the aquatic device;

angled grub screw means removably extending through the receptacle means and the insert means for removably securing the insert means and the fin to the receptacle means; and key means to tighten the screw means.

2. A fin mounting system for the aquatic device of claim 1 wherein the installation guide means has lines and sighting holes to align the guide with marks on the aquatic device, tab locater slots to accommodate tabs, and means to identify the outside edge direction of the aquatic device.

3. A fin mounting system for the aquatic device of claim 2 wherein the receptacle means has tabs configured to fit the tab locator slots and slanted threaded screw holes configured for accommodating the grub screws means.

4. A fin mounting system for the aquatic device of claim 3 wherein the insert means has slanted threaded screw holes that align with the holes in the receptacle means.

5. A fin mounting system for the aquatic device of claim 4 wherein the screws each have a longitudinal hole that accommodates the key means, wherein the key means comprises a hexagonal key with an enlarged handle.

6. A fin mounting system for the aquatic device of claim 1 wherein the installation guide means is adapted to be aligned with marks on the aquatic device and removably secured to the underside of the aquatic device with tape.

7. A fin mounting system for the aquatic device of claim 6 wherein the pocket is routed into the underside of the aquatic device and the outline of the pocket conforms to an inside boundary of the installation guide means and to an outside contour of the receptacle means.

8. A fin mounting system for the aquatic device of claim 7 wherein a mixture of resin, catalyst and milled fibers adhesively secures the receptacle means inside the pocket.

9. A fin mounting system for the aquatic device of claim 8 wherein the installation guide means is adapted to be removed after the resin has hardened.

10. A fin mounting system for the aquatic device of claim 9 wherein the insert means and the fin are adapted to be secured to the receptacle means with the grub screws means and the key means.

* * * * *